US009681230B2

(12) United States Patent
Uehara et al.

(10) Patent No.: US 9,681,230 B2
(45) Date of Patent: Jun. 13, 2017

(54) ACOUSTIC SYSTEM, OUTPUT DEVICE, AND ACOUSTIC SYSTEM CONTROL METHOD

(71) Applicant: YAMAHA CORPORATION, Hamamatsu-shi, Shizuoka-Ken (JP)

(72) Inventors: Haruki Uehara, Hamamatsu (JP); Katsuaki Tanaka, Hamamatsu (JP); Akihiko Suyama, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 14/885,068

(22) Filed: Oct. 16, 2015

(65) Prior Publication Data

US 2016/0112797 A1 Apr. 21, 2016

(30) Foreign Application Priority Data

Oct. 17, 2014 (JP) ..... 2014-213220
Aug. 20, 2015 (JP) ..... 2015-162509

(51) Int. Cl.
*H04R 3/04* (2006.01)
*G10H 1/00* (2006.01)
*H04H 60/04* (2008.01)

(52) U.S. Cl.
CPC ..... *H04R 3/04* (2013.01); *G10H 1/0058* (2013.01); *G10H 2240/175* (2013.01); *G10H 2240/305* (2013.01); *G10H 2240/325* (2013.01); *H04H 60/04* (2013.01); *H04R 2227/003* (2013.01);
(Continued)

(58) Field of Classification Search
None
See application file for complete search history.

(56) References Cited

U.S. PATENT DOCUMENTS 5,892,171 A * 4/1999 Ide ..... G10H 1/0058 84/622
7,968,787 B2 * 6/2011 Ueki ..... G10H 1/365 84/626
8,853,516 B2 10/2014 Arimoto et al.
(Continued)

FOREIGN PATENT DOCUMENTS

JP 2005064880 A 3/2005
JP 2011221157 A 11/2011
JP 2013077002 A 4/2013

OTHER PUBLICATIONS

Office Action issued in U.S. Appl. No. 14/885,167 mailed Sep. 14, 2016.
(Continued)

*Primary Examiner* — Paul Huber
(74) *Attorney, Agent, or Firm* — Rossi, Kimms & McDowell LLP

(57) ABSTRACT

An acoustic system includes a supply device, which is connected to a network and configured to supply an acoustic signal to the network, and at least one output device configured to output a sound based on the acoustic signal supplied from the supply device via the network. Also, the acoustic system includes a control unit, which is provided to the at least one output device on a one-to-one basis, and configured to control necessity/non-necessity of outputting the acoustic signal to an associated one of the at least one output device, based on frequency characteristics of the acoustic signal.

15 Claims, 6 Drawing Sheets

(52) U.S. Cl.
CPC .... *H04R 2227/005* (2013.01); *H04R 2420/03* (2013.01); *H04R 2499/15* (2013.01)

(56) References Cited

U.S. PATENT DOCUMENTS

| | | | | |
|---|---|---|---|---|
| 2003/0121401 | A1* | 7/2003 | Ito | G10H 1/0083 84/625 |
| 2005/0038922 | A1 | 2/2005 | Yamamoto et al. | |
| 2006/0107825 | A1* | 5/2006 | Hiratsuka | G10H 1/0058 84/622 |
| 2008/0080730 | A1* | 4/2008 | Takakusaki | H04R 5/02 381/300 |
| 2008/0236372 | A1* | 10/2008 | Uehara | G10H 1/0066 84/645 |
| 2011/0051936 | A1* | 3/2011 | Nakano | H04R 5/04 381/17 |
| 2013/0061733 | A1 | 3/2013 | Ohnishi et al. | |
| 2013/0077447 | A1* | 3/2013 | Hiratsuka | G10H 1/0066 367/199 |
| 2013/0092007 | A1 | 4/2013 | Ohnishi et al. | |
| 2013/0118333 | A1 | 5/2013 | Ohnishi et al. | |
| 2013/0321714 | A1* | 12/2013 | Kobayashi | H04N 5/2628 348/738 |
| 2014/0086415 | A1* | 3/2014 | Sim | G06F 1/1688 381/17 |

OTHER PUBLICATIONS

Office Action issued in U.S. Appl. No. 14/885,552 mailed Sep. 14, 2016.

* cited by examiner

ACOUSTIC SYSTEM, OUTPUT DEVICE, AND ACOUSTIC SYSTEM CONTROL METHOD

CROSS-REFERENCE TO RELATED APPLICATION

The present application claims priority from Japanese Applications JP 2014-213220 and JP 2015-162509, the content of which is hereby incorporated by reference into this application.

BACKGROUND OF THE INVENTION

1. Field of the Invention

The invention disclosed in this patent application relates to a technology for controlling a device configured to output an acoustic signal in a network to which a musical instrument and the like are connected.

2. Description of the Related Art

Hitherto, there has been an acoustic system configured to transmit, among others, music data (music playing event data such as MIDI data) and an acoustic signal (audio signal), or control data thereof (MIDI control data and acoustic control data) over a network that is built in compliance with a given communication standard (for example, a TCP/IP standard) (see Japanese Patent Application Laid-open No. 2005-64880, for example). In this acoustic system, a plurality of nodes, for example, a control device such as a personal computer and various output devices (an electronic piano, a speaker device, and the like), are connected via the network so that the plurality of output devices play music or the like in sync.

Some of the output devices are equipped with a soundboard vibration device, which is a soundboard with a vibrator mounted thereto (e.g., Japanese Patent Application Laid-open No. 2013-77002). For example, in Japanese Patent Application Laid-open No. 2013-77002, there is described an electric piano capable of generating a rich sound by vibrating the soundboard with the vibrator in a manner determined by acoustic signals.

SUMMARY OF THE INVENTION

Examples of speaker devices include, in addition to a full-range type capable of outputting sounds from bass to high range, woofers, which output bass sounds, a mid-range type, which outputs middle range sounds, and tweeters, which output high range sounds. With the soundboard vibration device, the sound quality is dependent on the frequency characteristics of an acoustic signal supplied to the vibrator, which vibrates the soundboard, because the shape and the like of the soundboard vary from one instrument type to another. For instance, at some frequencies of the acoustic signal supplied to the vibrator, there is a chance that a desired sound is not emitted from the soundboard, or that an unintended sound is emitted from the soundboard. An acoustic system that makes a more appropriate choice when selecting an output device to use based on a tune to be played or the like is therefore waited for.

One or more embodiments of the invention disclosed in this patent application is proposed in view of the problem described above, and an object of one or more embodiments of the present invention is to provide an acoustic system capable of switching from one of output devices connected to a network to another as a destination to which an acoustic signal is supplied.

In one or more embodiments of the present invention, an acoustic system includes a supply device, which is connected to a network and configured to supply an acoustic signal to the network, and at least one output device configured to output a sound based on the acoustic signal supplied from the supply device via the network. Also, the acoustic system includes a control unit, which is provided to the at least one output device on a one-to-one basis, and configured to control necessity/non-necessity of outputting the acoustic signal to an associated one of the at least one output device, based on frequency characteristics of the acoustic signal.

In one or more embodiments of the present invention, an output device, which is one of a plurality of output devices, includes an acoustic signal obtaining unit configured to obtain an acoustic signal and an optimum frequency characteristics obtaining unit configured to obtain, from each of the plurality of output devices each configured to output a sound based on the acoustic signal, optimum frequency characteristics of the each of the plurality of output devices. The output device includes a selection unit configured to select, from among the plurality of output devices, based on the acoustic signal and on the optimum frequency characteristics of each of the plurality of output devices, at least one output device to which the acoustic signal is to be output.

In one or more embodiments of the present invention, an acoustic system controlling method includes supplying an acoustic signal to a network by a supply device which is connected to the network and outputting a sound based on the acoustic signal supplied from the supply device via the network by at least one output device. The acoustic system controlling method also includes controlling necessity/non-necessity of outputting the acoustic signal to an associated one of the at least one output device, based on frequency characteristics of the acoustic signal, by a control unit, which is provided to the at least one output device on a one-to-one basis.

DETAILED DESCRIPTION OF THE INVENTION

Figure 1:
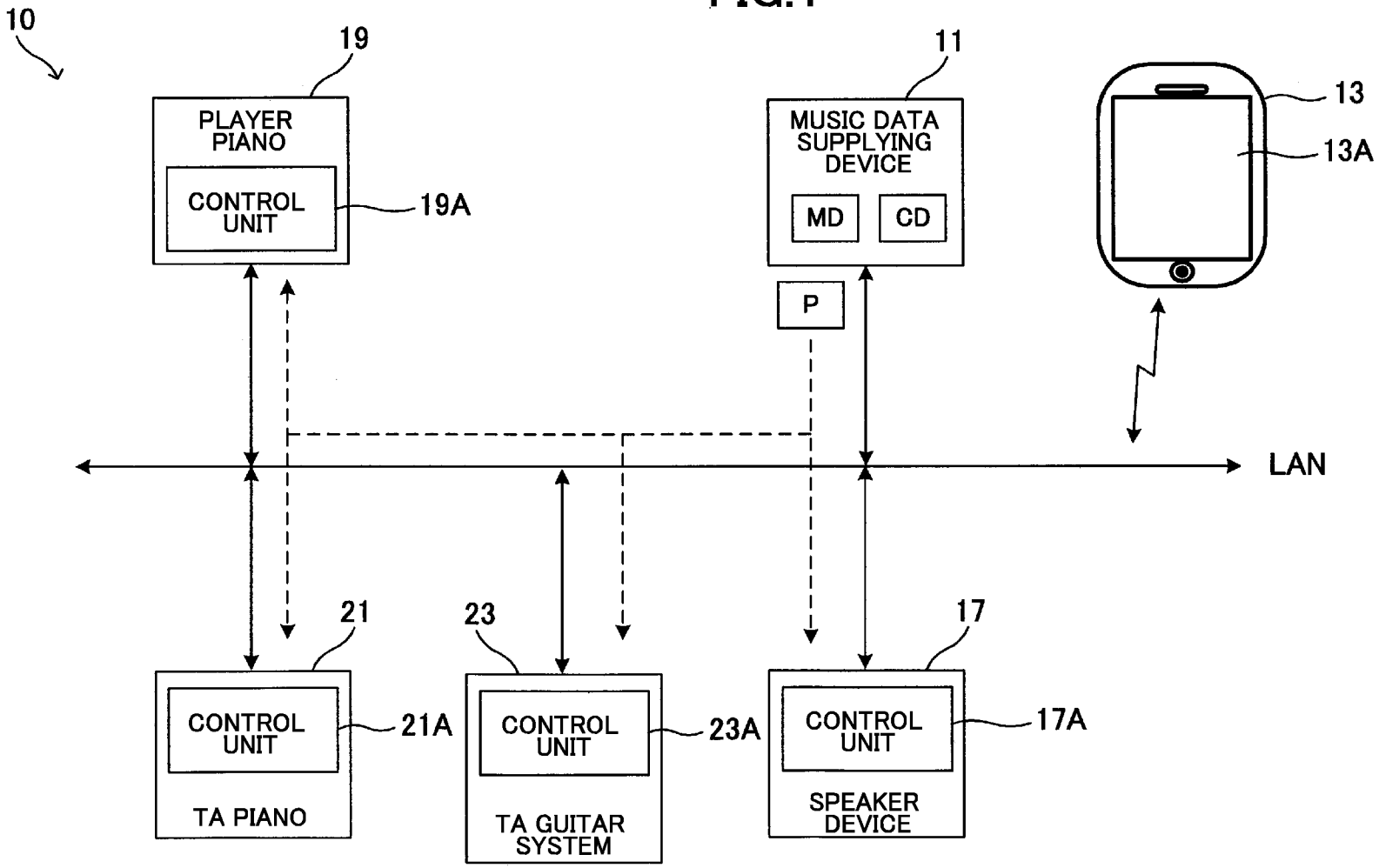
FIG. 1 is a block diagram for illustrating the configuration of an acoustic system according to an embodiment of the present invention.

Embodiments of the present invention are described below with reference to the accompanying drawings. FIG. 1 is a diagram of an acoustic system 10 according to an embodiment of the invention of this patent application. The acoustic system 10 includes a music data supplying device 11, a smartphone 13, a speaker device 17, a player piano 19, a TA piano 21, and a TA guitar system 23, which are connected to one another via a local area network (LAN).

The music data supplying device 11 is, for example, external storage that can be connected to a LAN, such as network-attached storage (NAS). The music data supplying device 11 stores, for example, signals such as music data MD, which is created by sampling a tune that is in the form of analog signals, and control data CD in which a music playing event such as MIDI data is set. The music data supplying device 11 is not limited to NAS, and can be other types of storage (a server or the like) that are capable of supplying the signals described above (the music data MD (audio signals) and music playing performance data (acoustic signals converted from music playing event data such as MIDI data)) to a network. The file format of the music data MD is not particularly limited, and can be, for example, MP3, WAVE, WMA, AAC, M4A, or FLAC.

The acoustic system 10 of this embodiment uses a given communication standard, for example, a communication standard that is compliant with a TCP/IP standard, to transmit a packet P over the LAN. The music data supplying device 11 converts the music data MD or the control data CD into the packet P, and transmits the packet P to the other devices of the acoustic system 10. The acoustic system 10 may employ a communication standard (network protocol) that uses an isochronous transmission method in order to implement this form of data exchange using packets. The acoustic system 10 is capable of controlling the devices to which the music data MD saved on the music data supplying device 11 is supplied, based on the specifics of the music data MD.

The communication standard used to transmit the packet P can be changed as seen fit. For instance, the communication standard used can be one for building a home network to which a plurality of electronic devices including home appliances, portable terminals, and personal computers are connected, such as the Digital Living Network Alliance (DLNA) (trademark). Another example is a communication standard that is used in a digital audio network such as the CobraNet (trademark). The network included in the acoustic system 10 can accordingly employ various communication modes of any network that is capable of transmitting acoustic signals (the music data MD and the like).

The smartphone 13 holds communication to and from an access point connected to the LAN by wireless communication that is compliant with IEEE 802.11, for example. The smartphone 13 includes, for example, a plurality of central processing units (CPUs), a memory, which stores programs executed by the respective CPUs, a RAM on which data is temporarily stored when the CPUs execute their respective programs, and an internal bus, which connects those devices to one another (the components are not shown). An application designed to control the acoustic system 10 in a centralized manner is installed in the smartphone 13. Various programs of this application are executed by the CPUs to implement various functions of the smartphone 13. The various functions of the smartphone 13 include, for example, obtaining the titles of tunes in the music data MD saved on the music data supplying device 11, creating a playlist, and displaying the playlist on a touch panel 13A.

The speaker device 17 includes a control unit 17A, which can be controlled by the application of the smartphone 13. The control unit 17A receives the packet P of the music data MD from the music data supplying device 11 via the LAN, and converts the packet P into analog audio signals. The speaker device 17 uses a built-in amplifier to amplify the analog audio signals, and emits the amplified sound. The smartphone 13 can control the control unit 17A in determining whether to obtain the music data MD from the music data supplying device 11. The smartphone 13 accordingly controls whether or not the speaker device 17 reproduces the music data MD by controlling the control unit 17A. The control unit 17A is not limited to a device built in the speaker device 17, and may be a separate device detachable from the speaker device 17. For example, the control unit 17A may be a device externally connectable to the speaker device 17 which includes, in addition to a connector to which a LAN cable is connected, a connector to which an acoustic cable for connection to the speaker device 17 is connected.

The player piano 19 is a device that plays music automatically by operating keys and pedals based on the control data CD (music playing performance data or the like), which is supplied from the music data supplying device 11. In addition to playing music automatically, the player piano 19 receives with a control unit 19A the music data MD supplied from the music data supplying device 11, amplifies the received data with a built-in amplifier, and emits the amplified sound from a speaker unit (not shown). Similarly to the speaker device 17, whether or not the player piano 19 reproduces the music data MD is controlled by the smartphone 13 by controlling the control unit 19A.

Figure 2:
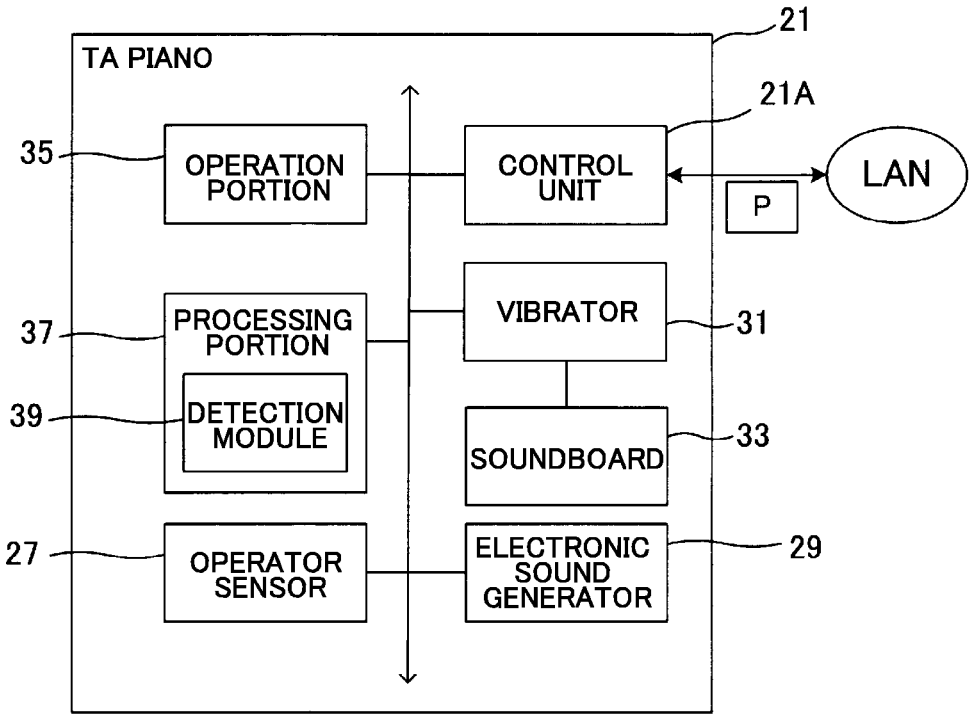
FIG. 2 is a block diagram for illustrating the configuration of a TA piano.

The TA piano 21 is a device that reproduces the music data MD with the use of the TransAcoustic (trademark) technology. The TA piano 21 has an exterior appearance of a normal grand piano or upright piano, and is put in a suitable place. The TA piano 21 is similar to common electronic pianos in that, in addition to an operator sensor 27, which detects the operation of music play operators (keys, hammers, pedals, and the like), and an electronic sound generator 29, which generates signals of an electronic sound by analyzing detection signals of the operator sensor 27, a control unit 21A, a vibrator 31, a soundboard 33, an operation portion 35, and a processing portion 37 are included as illustrated in FIG. 2. What is illustrated in FIG. 2 is a part of the configuration of the TA piano 21. The control unit 21A receives the packet P of the music data MD from the music data supplying device 11, and converts the received data into drive signals for the vibrator 31. The processing portion 37 includes a processing circuit such as a CPU, and controls whether or not the control unit 21A converts the music data MD and whether or not the drive signals are supplied to the vibrator 31 both. The vibrator 31 is mounted to the soundboard 33 and vibrates in a manner that is determined by the amplitude or frequency of the waveform of the supplied drive signals, thereby vibrating the soundboard 33 and causing the soundboard 33 to emit sound. The drive signals for the vibrator 31 which are created through conversion and output by the control unit 21A may be the same as the analog audio signals created through conversion and output by the control unit 17A of the speaker device 17.

The operation portion 35 is a device that has an input/output function of the TA piano 21, and includes a display portion and operation switches among others. The processing portion 37 switches the TA piano 21 from one mode to another out of, for example, three modes, depending on the specifics of operation performed by a user on the operation portion 35. A first mode is a normal mode in which a player hits keys and thereby operates the hammers so that sound is generated solely through the stroke of a string by a hammer as in a common grand piano. A second mode is a TA mode in which the stroke of a string by a hammer is prohibited and the soundboard 33 is vibrated by the vibrator 31 in a manner that is determined by the music data MD supplied by the music data supplying device 11, or in a manner that is determined by electronic sound signals generated by the electronic sound generator 29 from the playing of the TA piano 21 itself by a player. The TA piano 21 in the TA mode can switch, for example, between the music data MD and electronic sound signals generated by playing the TA piano 21 as signals on which drive signals supplied to the vibrator 31 are based. A third mode is a combination mode in which sound is generated by the stroke of a string as in the normal mode and the soundboard 33 is also vibrated by the vibrator 31.

A detection module 39 of the processing portion 37 determines whether or not the TA piano 21 is in a state where sound can be emitted from the soundboard 33 by operating the vibrator 31 based on the music data MD. This processing by the detection module 39 is implemented by, for example, the CPU of the processing portion 37 by executing a corresponding program. The vibrator 31 operates in, for example, the second mode and the third mode out of the three modes described above. In other words, the music data MD for operating the vibrator 31 is unnecessary in the first mode. The detection module 39 determines whether or not the music data MD is necessary in response to the setting or switching of a mode, and notifies the smartphone 13 of the determination via the LAN. The smartphone 13 controls the control unit 21A based on the notification from the detection module 39 to change settings about whether or not the control unit 21A is to obtain the music data MD from the music data supplying device 11. When the TA piano 21 is in the first mode, for example, the smartphone 13 stops the control unit 21A from executing processing of obtaining the packet P that corresponds to the music data MD.

The method of detection by the detection module 39 is not limited to the determination based on the current mode of the TA piano 21. For instance, the detection module 39 may determine that the music data MD is unnecessary when the operation switches of the operation portion 35 are operated to power off the TA piano 21, then notifying the smartphone 13 of the determination. Similarly to the TA piano 21, the speaker device 17 and the player piano 19 may each include a detection module that detects whether or not the device is in a state where the music data MD can be received and reproduced (a power on state or the like).

Figure 3:
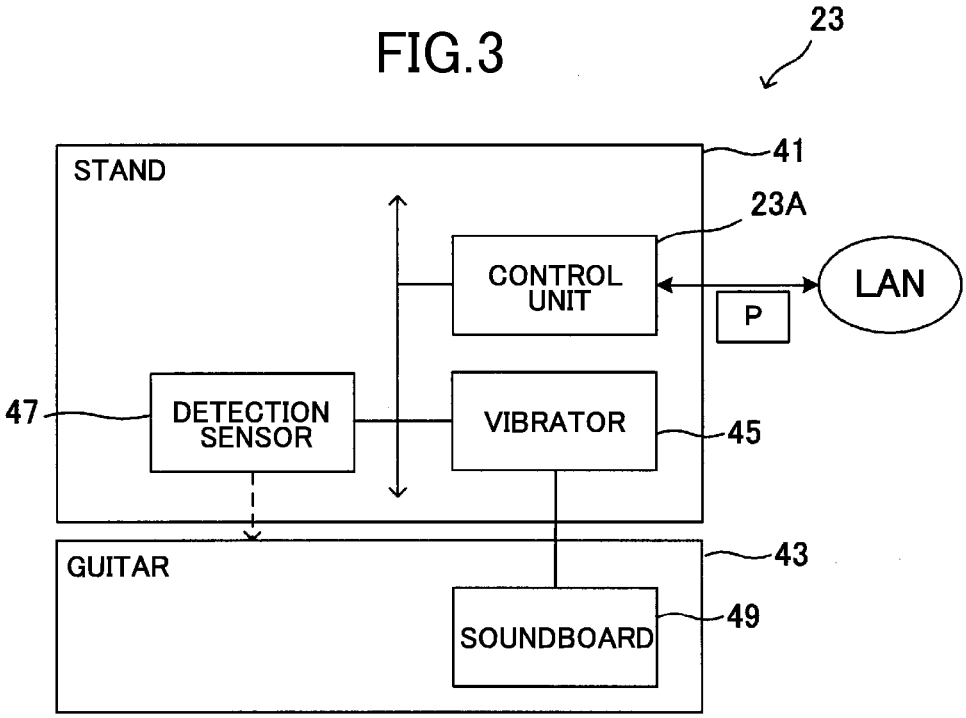
FIG. 3 is a block diagram for illustrating the configuration of a TA guitar system.

The TA guitar system 23 is a device that reproduces the music data MD with the use of the TransAcoustic (trademark) technology. The TA guitar system 23 includes, as illustrated in FIG. 3, a guitar 43, which has an exterior appearance of an acoustic guitar, and a stand 41 on which the guitar 43 is set, and is set up in a suitable place. The stand 41 is provided with, in addition to a control unit 23A, a vibrator 45 and a detection sensor 47. The control unit 23A converts the packet P that corresponds to the music data MD and that is received from the music data supplying device 11 into drive signals that are supplied to the vibrator 45. The vibrator 45 vibrates a soundboard 49 of the guitar 43 put on the stand 41. The vibrator 45 receives a supply of drive signals that reflect the motion of a tune in the music data MD which has been converted by the control unit 23A, to thereby vibrate the soundboard 49 and cause the soundboard 49 to emit sound. The drive signals for the vibrator 45 which are created through conversion and output by the control unit 23A may be the same as the analog audio signals created through conversion and output by the control unit 17A of the speaker device 17.

The detection sensor 47 is a sensor capable of detecting whether or not the guitar 43 is on the stand 41 at the moment. The detection sensor 47 includes a relay switch, which is activated when, for example, the guitar 43 is put in a given place on the stand 41, and a processing circuit, which processes a signal of the relay switch. The detection sensor 47 detects whether the guitar 43 is on the stand 41 or off the stand 41 (because of being used by a user or for other reasons), and notifies the result of the detection to the smartphone 13. Based on the notification from the detection sensor 47, the smartphone 13 controls whether or not the control unit 23A is to obtain the music data MD from the music data supplying device 11. The detection sensor 47 may be other sensors that are capable of detecting the state of the guitar 43 (an infrared sensor or the like).

The thus configured acoustic system 10 of this embodiment switches the output device to which the music data MD saved on the music data supplying device 11 is supplied (one of the speaker device 17, the TA piano 21, the TA guitar system 23, and the player piano 19), based on the specifics of the music data MD. In the case of a piano tune, for example, the acoustic system 10 uses the TA piano 21 or the player piano 19 to reproduce the music data MD, and uses the TA guitar system 23 in the case of a guitar tune. Whether the supplied signals are of a piano tune, a guitar tune, or other types of tune may be detected by performing time analysis on the music data MD itself and determining the type of tune from frequency characteristics, or may be determined from an identifier attached to the tune. In frequency characteristics analysis, for example, a method involving extracting feature points from acoustic signals at given time intervals for comparison or the like, which is described in Japanese Patent Application Laid-open No. 2011-221157, can be employed. Specifically, the frequency characteristics of the music data MD may be analyzed by creating a component matrix in which component values observed on a unit band-by-unit band basis in a unit time are aligned in a time axis direction and a frequency axis direction, creating a phase shift matrix through a phase shift of the component matrix in the time axis direction, calculating a difference between each component value in the component matrix and a corresponding component value in the phase shift matrix, extracting a value that indicates a feature from the calculated difference, and processing the extracted value.

Figure 4:
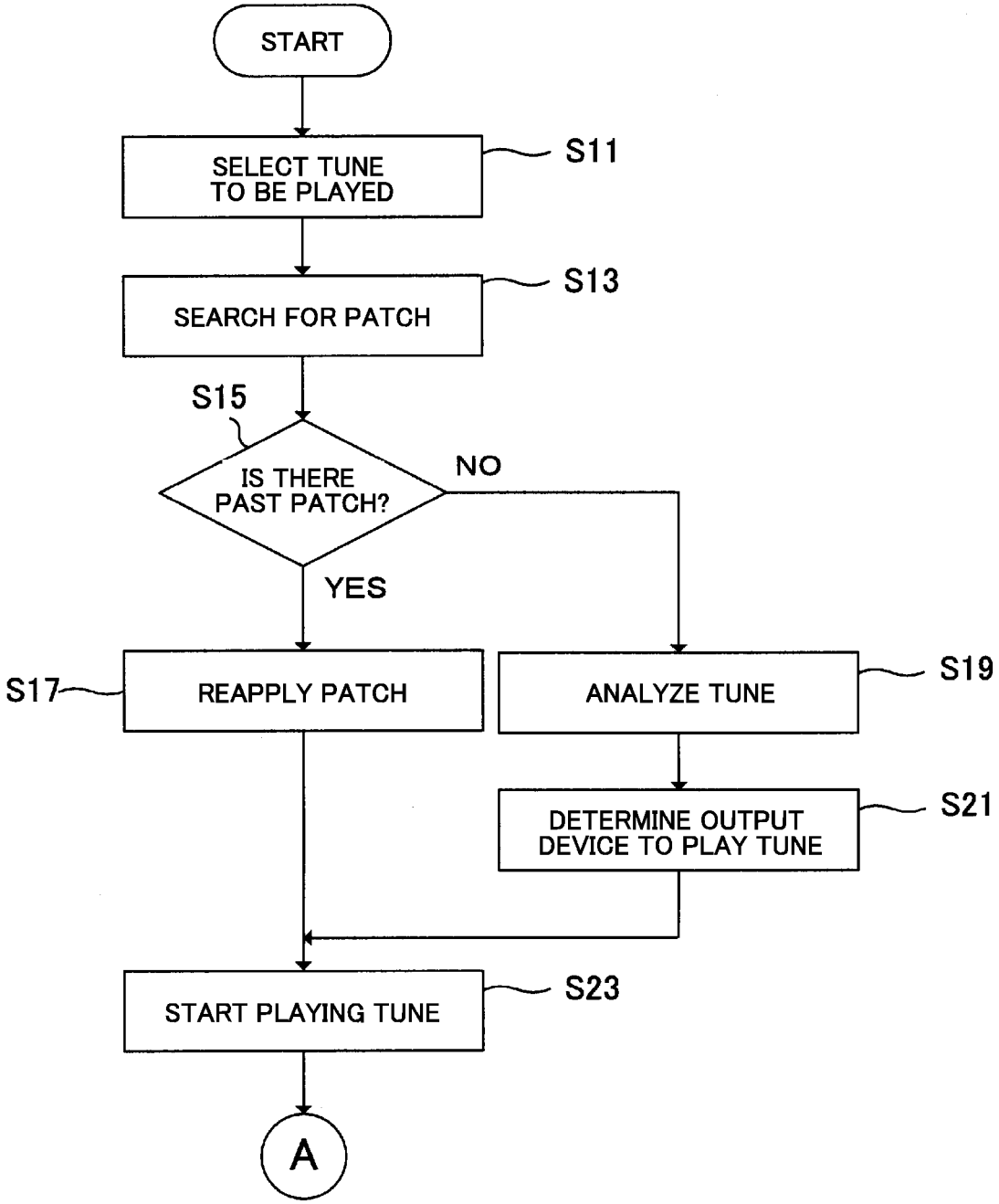
FIG. 4 is a flow chart for illustrating the processing specifics of music data reproduction operation.

Processing of music data MD reproduction operation by the acoustic system 10 is described next with reference to FIG. 4. First, in Step (hereinafter abbreviated as "S") 11, that is, in S11 of FIG. 4, the user operates the smartphone 13 to play on the acoustic system 10 a tune of his/her choice out of tunes saved on the music data supplying device 11. When the user selects a tune (a piece of the music data MD) from a playlist (S11), the application of the smartphone 13 searches for a patch that has been set in the past for the title of the selected tune (S13). The "patch" here is a virtual patch for logically setting an arbitrary connection between a plurality of nodes (the speaker device 17, the TA piano 21, and other components) connected via the LAN. The acoustic system 10 transmits the music data MD or the control data CD from an output-side node (the music data supplying device 11) set by the patch to an input-side node (the speaker device 17 or other devices) set by the patch.

The smartphone 13 includes, for example, a non-volatile memory (flash memory or the like) as storage on which an applied patch is saved. In S35 (see FIG. 5) described later, the smartphone 13 saves information about the piece of the music data MD that has just been reproduced in the flash memory in association with the settings of a patch used to play the tune in the music data MD. The smartphone 13 therefore searches in S13 patches that have been set in the past and saved in the flash memory to determine whether or not the saved patches include one that is associated with the piece of the music data MD selected by the user from the playlist (S15). A patch may be set in advance to a piece of the music data MD saved on the music data supplying device 11. For instance, a patch that chooses the player piano 19 or the TA piano 21 as the output device may be set in advance to the music data MD of a piano tune. The patch determining processing by the smartphone 13 can be omitted in this case.

In the case where a patch that meets the criteria is found (S15: YES), the smartphone 13 reapplies the past patch and starts reproducing the piece of the music data MD selected by the user (S23). In the case where the search does not find a patch that meets the criteria (S15: NO), on the other hand, the smartphone 13 analyzes the selected tune (S19). While various methods can be used for the tune analysis (for example, the method described in Japanese Patent Application Laid-open No. 2011-221157), the description here is given with the analysis of a tune's frequency characteristics in mind. Other possible tune analyzing methods include processing of reading information that is preset by the user tune by tune, and processing of reading a default value that is set in advance to each tune. The sound quality of a musical instrument that uses the TransAcoustic Technology such as the TA piano 21, namely, the quality of a sound that is emitted by vibrating the soundboard 33 with the use of the vibrator 31, depends greatly on the frequency characteristics of the music data MD supplied to the vibrator 31. This is because the soundboard 33 and the soundboard 49, which are components of different types of musical instrument (the TA piano 21 and the TA guitar system 23), are different in shape, material, and the like, and accordingly resonate in different frequency ranges. Among musical instruments that use the TransAcoustic Technology, in what modes the soundboards 33 and 49 vibrate and what sound the soundboards 33 and 49 emit in response to the same music data MD supplied therefore vary from each other depending on the characteristics of the soundboards 33 and 49 with respect to vibration.

For example, in the case where the music data MD that is generated by other sound generators than pianos and ones having a tone timbre similar to that of pianos is supplied to the TA piano 21, the vibrator 31 does not provide vibration that reflects the vibration characteristics of the soundboard 33, which means that the soundboard 33 may not emit a desired sound. The smartphone 13 therefore analyzes the frequency characteristics of a piece of the music data MD selected by the user to choose which output device (out of the speaker device 17, the player piano 19, the TA piano 21, and the TA guitar system 23) is to reproduce the selected piece of the music data MD, and sets this output device as a patch (S21). The smartphone 13 desirably executes processing of making an inquiry to the output devices on the network in advance, for example, before starting S11 (when the application is activated or at other points preceding S11) to obtain, from each output device, information about what frequency characteristics are optimum for the music data MD supplied to the output device.

When the analysis of the piece of the music data MD selected by the user results in the detection of frequency characteristics that are close to those of a piano sound generator, for example, the smartphone 13 chooses the player piano 19 and the TA piano 21 as the output devices to which the music data MD is supplied from the music data supplying device 11 (S21). The control units 19A and 21A of the chosen player piano 19 and TA piano 21 execute processing of obtaining the music data MD from the music data supplying device 11, and the player piano 19 and the TA piano 21 reproduce the music data MD in sync (S23).

When the analysis of the selected piece of the music data MD results in the detection of frequency characteristics that are close to those of a guitar sound generator, for example, the smartphone 13 chooses the TA guitar system 23 as the output device. When the analysis results in the detection of frequency characteristics that belong to none of piano sound generators and guitar sound generators, for example, the smartphone 13 chooses the speaker device 17 as the output device. In this manner, the acoustic system 10 of this embodiment is capable of choosing an output device that is optimum for a piece of the music data MD and reproducing the piece of the music data MD on the optimum output device. After setting a patch in S17 or S21, the smartphone 13 may display the determined patch on the touch panel 13A to prompt the user to make a final decision or change the patch. This enables the user to compare the specific piece of the music data MD and the determined patch so that the piece of the music data MD is reproduced on the output device of his/her choice.

Figure 5:
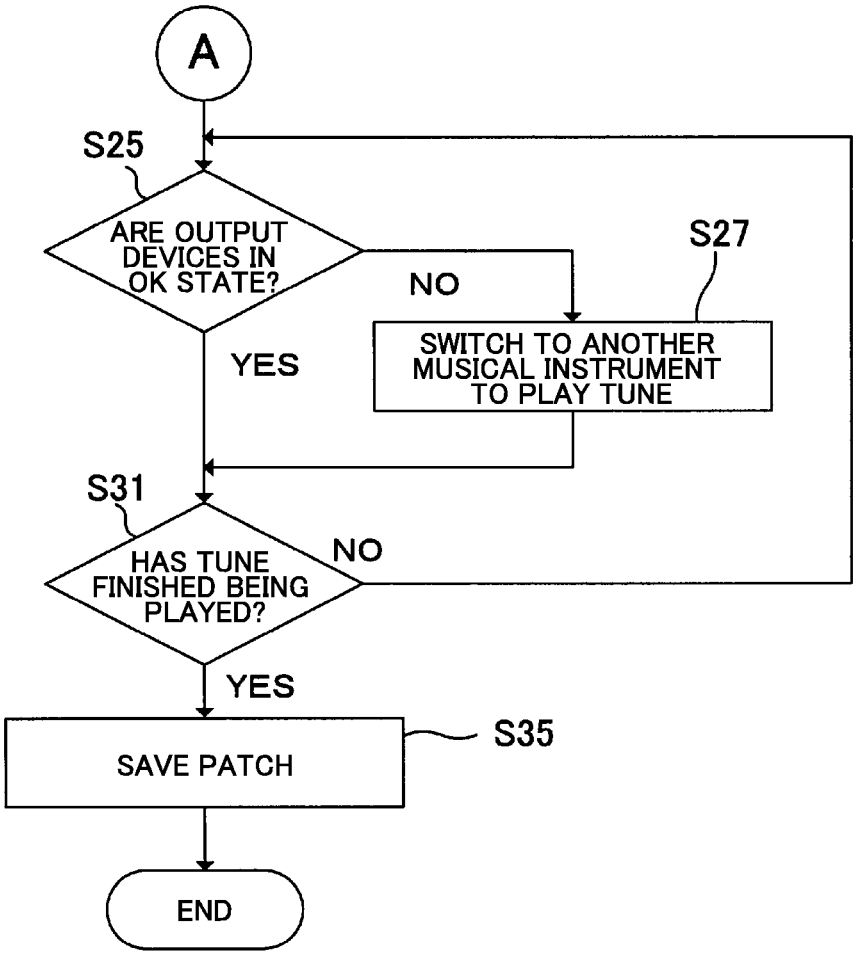
FIG. 5 is a flow chart for illustrating the processing specifics of the music data reproduction operation.

In S25 of FIG. 5, the smartphone 13 determines, for each output device (the TA piano 21 and others), whether the output device is in a state where the music data MD can be reproduced, based on the notification from the detection module 39 or the detection sensor 47 of the output device. In the case where every output device to which the music data MD is supplied is in a fine state with no problems (S25: YES), the smartphone 13 determines whether or not the reproduction of the music data MD has finished (S31). In the case where the reproduction of the music data MD has not been finished yet (S31: NO), the smartphone 13 repeatedly executes S25 and subsequent steps at each given timing. The smartphone 13 thus monitors the state of each output device while the music data MD is being reproduced.

When detecting that at least one of the output devices is in a state where the music data MD cannot be reproduced (S25: NO), the smartphone 13 stops the supply of the music data MD to the output device in a state where the music data MD cannot be reproduced (S27). For example, when detecting from a notification of the detection module 39 that the TA piano 21 has switched from the second mode to the first mode, the smartphone 13 stops the control unit 21A from executing the processing of obtaining the music data MD. When subsequently detecting from a notification of the detection module 39 that the TA piano 21 has switched back to the second mode (S25: NO), the smartphone 13 allows the control unit 21A to resume the processing of obtaining the music data MD (S27). The supply of the music data MD to the TA piano 21 is resumed in this manner.

In S27, in addition to stopping the supply of the music data MD, the smartphone 13 may execute processing of switching the supply destination output device to another output device. For instance, when detecting from a notification of the detection sensor 47 that the guitar 43 is off the stand 41, the smartphone 13 may execute processing of starting the supply of the music data MD to another output device (the speaker device 17 or others) in addition to stopping the supply of the music data MD to the TA guitar system 23. When the described processing including the mid-reproduction detection processing is executed and the reproduction of the music data MD is finished (S31: YES), the smartphone 13 saves the piece of the music data MD that has just been reproduced in association with the applied patch in the flash memory or the like as settings (S35), and ends the whole processing. Saving a patch in the flash memory or the like may be executed not only when the reproduction of a piece of the music data MD is finished but also when any switch between patches takes place (for example, immediately after S27).

The music data MD and the control data CD are examples of acoustic signals. The music data supplying device 11 is an example of a supply device. The speaker device 17, the player piano 19, the TA piano 21, and the TA guitar system 23 are examples of output devices. The smartphone 13 is an example of a control device. The soundboards 33 and 39 are examples of vibrated bodies. The detection module 39 and the detection sensor 47 are examples of detection portions.

The embodiment described above has the following effect:

The detection module 39 of the TA piano 21 determines whether or not the music data MD is necessary in response to the setting or switching of a mode, and notifies the smartphone 13 of the determination. The detection sensor 47 of the TA guitar system 23 detects whether the guitar 43 is on or off the stand 41, and notifies the result of the detection to the smartphone 13. This enables the smartphone 13 to stop the supply of the music data MD and switch the music data supply destination to another output device depending on the state of the TA piano 21 and the TA guitar system 23.

It should be understood that the present invention is not limited to the embodiment described above, and may be subjected to various improvements and modifications without departing from the gist of the present invention.

For example, in the case where a single piece of the music data MD includes a guitar solo part and a piano solo part, the smartphone 13 may make a switch between output devices in time with each solo.

While the embodiment described above deals with a case where one file of the music data MD saved on the music data supplying device 11 is supplied to the output devices, the acoustic system 10 may be configured so that a plurality of related files are simultaneously supplied to optimum output devices. For instance, consider a case where the music data supplying device 11 stores music data MD of guitar tunes and control data CD that can be reproduced together with this music data MD. The smartphone 13 in this case may supply the control data CD to the player piano 19 while supplying the music data MD of guitar tunes to the TA guitar system 23 so that the TA guitar system 23 plays a guitar tune in concert with piano play by the player piano 19.

In the case where a piece of the music data MD that is selected by the user in S11 in the embodiment described above is associated with another piece of the music data MD (a piano part or a guitar part), the smartphone 13 may analyze the frequency characteristics of the pieces of the music data MD to determine the supply destination of each piece of the music data MD separately, and then distribute the pieces of the music data MD concurrently.

Figure 6:
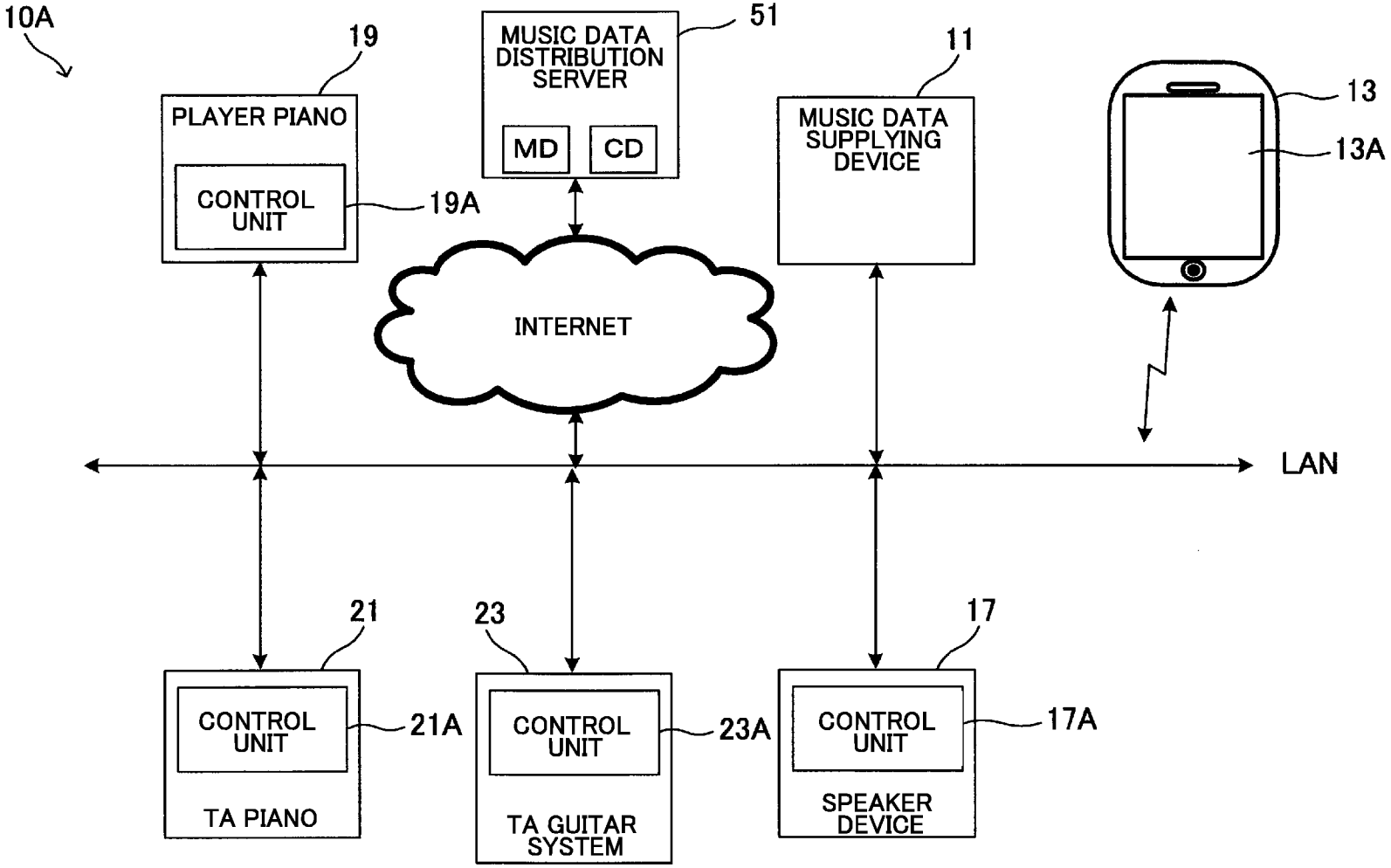
FIG. 6 is a block diagram for illustrating the configuration of an acoustic system according to another embodiment of the present invention.

The embodiment described above takes the music data supplying device 11 as an example of a supply device that supplies acoustic signals to a network in this patent application. The supply device, however, is not limited to the music data supplying device 11. For example, a distribution server on the Internet may be employed as the supply device. FIG. 6 is a diagram for illustrating the configuration of an acoustic system 10A according to another embodiment of the present invention. Components of the acoustic system 10A that are similar to those in the embodiment described above are denoted by the same reference symbols, and descriptions thereof are omitted when appropriate. In the acoustic system 10A, the output devices obtain and reproduce the music data MD that is saved on a music data distribution server 51 on the Internet. The music data distribution server 51 is, for example, a server that is provided for public access by a vendor who runs a music distribution business or other entities, and the music data MD can be obtained from the music data distribution server 51 by a given communication standard (the HTTP protocol or the like). For instance, when a user of the acoustic system 10A uses the smartphone 13 to select a desired tune from the music data MD saved on the music data distribution server 51, the smartphone 13 chooses an output device to which the tune is supplied. The control unit (e.g., the control unit 17A) of each chosen output device executes processing of obtaining the piece of the music data MD selected by the user from the music data distribution server 51. The chosen output devices then execute in sync the streaming reproduction of the piece of the music data MD downloaded by their control units (e.g., the control unit 17A).

The thus configured acoustic system 10A is also capable of providing the same effect as that of the acoustic system 10. The acoustic system 10A may save apiece of the music data MD downloaded from the music data distribution server 51 on the music data supplying device 11 or in other places first and then supply the saved piece to each relevant output device from the music data supplying device 11, instead of reproducing the downloaded piece by streaming. The smartphone 13 in this case may execute the downloading of the music data MD from the music data distribution server 51 to the music data supplying device 11.

The smartphone 13 in the embodiment described above may function as a supply device. For example, when the user selects one of a plurality of pieces of the music data MD saved on the smartphone 13, the smartphone 13 may supply the selected piece of the music data MD to each relevant output device. The acoustic system 10 can omit the music data supplying device 11 in this case. The smartphone 13 in this case does not need to control each control unit (e.g., the control unit 17A).

The player piano 19 in the embodiment described above may function as a supply device. For example, in the case where a LAN for a home network is utilized, the player piano 19 that is put in a kid's room may be set as the output side, with the TA piano 21 that is put in the living room set as the input side. In this configuration, audio signals of a sound generated from the playing of the player piano 19 by a player can be transmitted over the LAN to emit the sound from the soundboard 33 of the TA piano 21.

Figure 7:
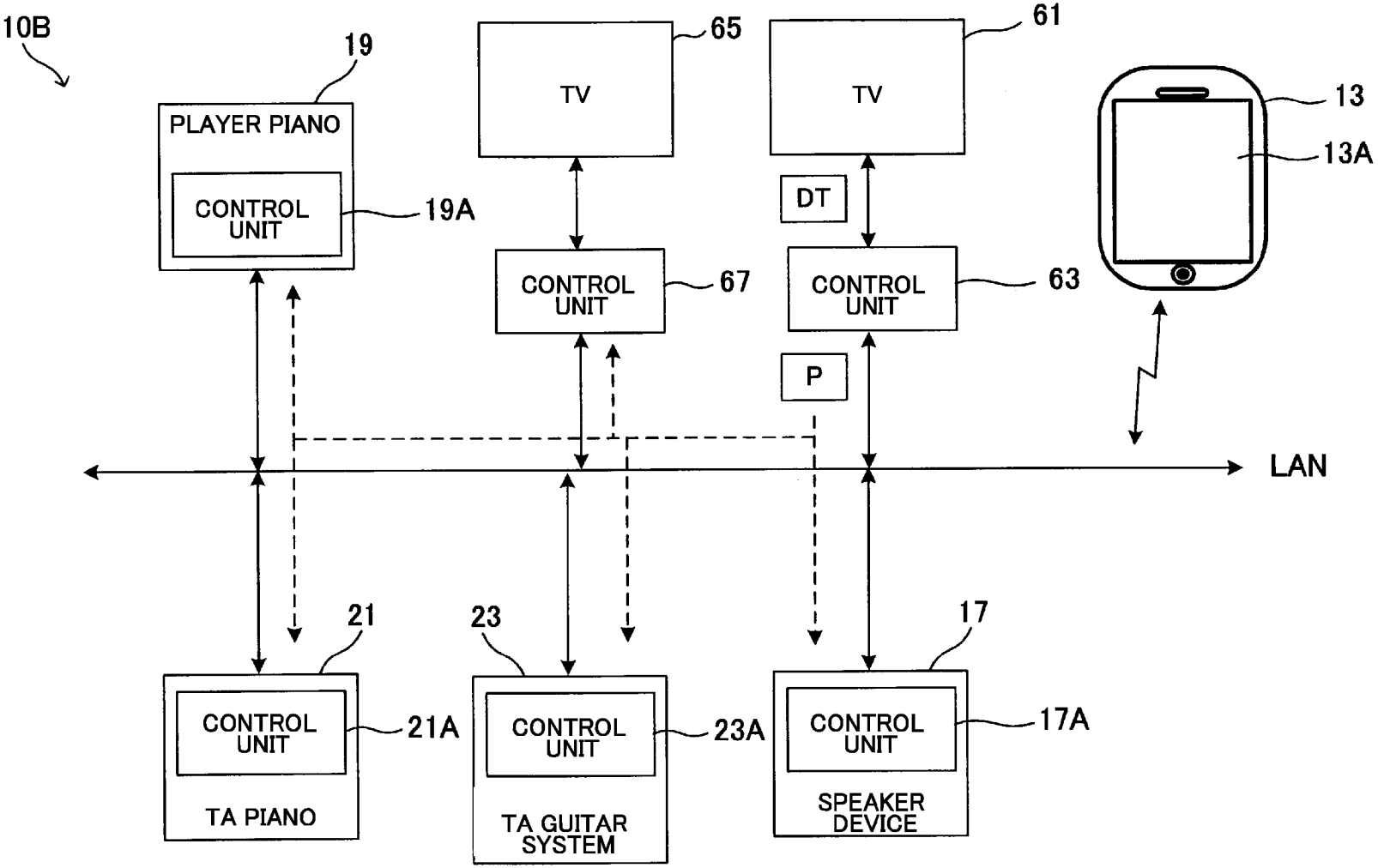
FIG. 7 is a block diagram for illustrating the configuration of an acoustic system according to still another embodiment of the present invention.

In the embodiment described above, a piece of common audio equipment such as a TV or a radio may function as a supply device. FIG. 7 is a diagram for illustrating the configuration of an acoustic system 10B according to still another embodiment of the present invention. The acoustic system 10B includes a TV 61, which is connected to the LAN via a control unit 63. The control unit 63 is a device that is externally mountable to the TV 61 and that includes, for example, a LAN connector and a connector to which an acoustic cable can be connected. The control unit 63 converts, for example, an analog audio signal DT output from the TV 61 into a digital audio signal through real-time encoding, and supplies the converted signal as the packet P to each relevant output device. The output device to which the packet P is supplied converts the received packet P to reproduce the audio signal DT. The smartphone 13 in this case may determine to which output device the packet P is to be supplied by determining the type of music (a piano tune, a guitar tune, or the like) that is broadcast in a television program in question from, for example, information on listings of digital television broadcast programs.

The acoustic system 10B may include video of the TV 61 as well as audio in the audio signal DT. As illustrated in FIG. 7, in the acoustic system 10B, a TV 65, in addition to the TV 61, is connected to the LAN via a control unit 67. The TV 65 is set up in a room or other places separate from where the TV 61 is installed. The control unit 67 extracts audio and video from the packet P received from the control unit 63, and supplies the extracted audio and video to the TV 65. In the thus configured acoustic system 10B, when the TV 61 receives a television program of a classic concert, for example, audio can be played by the TA piano 21 and the TA guitar system 23 in sync while video is displayed on the TV 65, thereby presenting audio and video with a more realistic sensation to the user.

While the smartphone 13 in the embodiment described above executes the state detection in which the detection module 39 and the detection sensor 47 detect the state of their output devices after the reproduction of the music data MD is started, the state detection may be executed before the reproduction to execute the processing of switching the output destination. Alternatively, the smartphone 13 may execute the detection by the detection module 39 and other similar components and the patch switching before and during the reproduction both.

In the case where a lossless compression file format in which multi-channel (5.1 ch or the like) audio signals can be saved in a single file, such as the FLAC format, is employed as the file format of the music data MD in the embodiment described above, the smartphone 13 may execute control that varies the supply destination output device from one channel to another. The multi-channel may be implemented as a multi-track file having four channels through which signals are output to four speaker devices 17, one channel for signal output to the TA guitar system 23, one channel for signal output to the TA piano 21, and one control channel for signal output to the player piano 19, seven channels in total. The smartphone 13 may vary the supply destination output device from one channel to another also when the data format employed allows the music data MD and the control data CD to be set for each channel separately by dividing the interior of the single packet P into channels as in the CobraNet (trademark).

While the embodiment described above takes the smartphone 13 as an example of the control device, the control device is not limited to the smartphone 13 and may be other portable terminals or a personal computer. The TA guitar system 23, which, in the embodiment described above, has the vibrator 45 that is included in the stand 41, is not limited to this configuration, and the vibrator 45 may be mounted to the guitar 43. The soundboard 49 in this case may be vibrated by sending audio signals through wireless transmission from the control unit 23A of the stand 41 to the vibrator 45 of the guitar 43.

The processing procedures (FIG. 4 and FIG. 5) in the embodiment described above are given as an example, and the order thereof may be changed and steps may be added, deleted, replaced, or otherwise modified as seen fit.

In the embodiment described above, whether or not the music data MD is to be supplied is set to each control unit (e.g., the control unit 17A) under control of the smartphone 13. Alternatively, the control unit 17A and other control units may have a function of determining whether or not the music data MD is to be supplied depending on the characteristics of their associated output devices.

For example, when the user selects a tune, the smartphone 13 performs control that supplies the selected piece of the music data MD from the music data supplying device 11 to all output devices connected to the LAN (the speaker device 17, the TA piano 21, and others), which means that each output device on the network receives the same data. The control unit 21A, for example, receives out of the received music data MD a piece of the music data MD that has frequency characteristics suitable to the vibration characteristics of the soundboard 33 of the TA piano 21. The control unit 21A may instead analyze the frequency characteristics of the received piece of the music data MD to extract only a necessary frequency component. The control unit 21A may be configured so as to include, for example, a filter or an equalizer to execute processing of extracting only a frequency component suitable to the vibration characteristics of the soundboard 33, enhancing processing, decreasing processing, or the like. In this configuration, the control unit 17A or other control units on the output device side executes processing of determining whether or not the packet P of the music data MD supplied to the LAN is suitable for the output device. This eliminates the need for the smartphone 13 to determine to which output device the music data MD is to be supplied, and the smartphone 13 only needs to perform control that broadcasts the music data MD to every output device on the LAN. The acoustic system 10 may also be configured so that the music data supplying device 11 is operated to broadcast the same piece of the music data MD to all output devices and so that the output device side executes the necessary extraction processing on the piece of the music data MD. The acoustic system 10 in this case may not include the smartphone 13.

The control unit 17A and other control units may each determine whether to supply a piece of the music data MD to the output device that is associated with the control unit by, for example, analyzing the frequency of the piece of the music data MD contained in the packet P, or processing data that is set to the packet P (e.g., information about an output device to which the packet P is to be supplied). For example, a multi-track file in which a flag value indicating the tone timbre or the frequency characteristics (an identifier identifying data for a piano, data for a guitar, or the like) is attached to each track may be used as the music data MD. The flag value may be set in advance by, for example, a vendor that runs a music distribution business. Alternatively, a unique flag value may be set to each track of the music data MD so that the smartphone 13 analyzes the frequency characteristics of the track for determination on the output device side. The output device side, for example, the control unit 21A of the TA piano 21, may receive the packet P of the music data MD supplied to the LAN and, when the music data MD includes a track to which a flag value for a piano is set, supply to the vibrator 31 drive signals converted from data of this track. In short, each control unit on the output device side may determine whether or not the music data MD is necessary based on the flag value that reflects the frequency characteristics. In this configuration also, the smartphone 13 does not need to determine the destination to which the music data MD is supplied and only needs to broadcast the same multi-track music data MD to every output device on the LAN. The acoustic system 10 in this case has no need for control by the smartphone 13, and can omit the smartphone 13.

Alternatively, the control unit 17A and other control units may each determine whether to supply the music data MD to the output device that is associated with the control unit based on the user's operation instruction. For example, whether to supply the music data MD to the TA piano 21 may be changed by the user by operating the operation portion 35 (see FIG. 2). In this case, for example, when the tune to be played by the acoustic system 10 is a piano tune, the user can set the TA piano 21 so that the music data MD of the packet P received by the TA piano 21 is reproduced in the TA piano 21 by operating the operation portion 35 and other components of the TA piano 21 in advance.

While the embodiment described above takes as an example musical instruments that respectively include the soundboards 33 and 49 as the vibrated bodies in the invention of this patent application, the vibrated body in the invention of this patent application is not limited thereto. For instance, the vibrated body can be a bell of a wind instrument such as a trumpet or a clarinet. The vibrator in this case may be mounted to a stand to be inserted to the bell of, for example, a trumpet to hold the trumpet, and put into operation to cause the trumpet to emit sound. An output device that includes such a wind instrument and a stand as those may be controlled by the acoustic system 10 described above. A musical instrument that includes the vibrated body in the invention of this patent application can also be a percussion instrument such as a drum.

The acoustic system 10 of the embodiment described above includes a plurality of output devices (the TA piano 21 and others) connected to a network. However, the acoustic system 10 is not limited thereto and may have, for example, a configuration in which the music data supplying device 11 and one output device (e.g., the TA piano 21 alone) are connected to the LAN. In this case, the control unit 21A of the TA piano 21 may execute control such as starting/stopping the supply of a drive signal to the vibrator 31, or changing the frequency characteristics of the wavelength of a drive signal to be supplied.

An acoustic system according to the technology disclosed in this patent application includes, for example: a supply device, which is connected to a network and configured to supply an acoustic signal to the network; at least one output device configured to output a sound based on the acoustic signal supplied from the supply device via the network; and a control unit, which is provided to the at least one output device on a one-to-one basis, and configured to control necessity/non-necessity of outputting the acoustic signal to an associated one of the at least one output device, based on frequency characteristics of the acoustic signal.

The control unit in this acoustic system controls the necessity/non-necessity of outputting an acoustic signal to its associated output device based on the frequency characteristics of the acoustic signal. The necessity/non-necessity of output here includes, in addition to the simple feasibility of outputting an acoustic signal, in what state the acoustic signal is to be supplied (for example, with the frequency of the acoustic signal extracted or changed). The control unit controls the necessity/non-necessity of output to an output device by, for example, analyzing the frequency of the acoustic signal or determining the necessity/non-necessity based on information that is set in advance to data related to the acoustic signal. Alternatively, the control unit controls the necessity/non-necessity of output as instructed by an operation instruction that is given by a user as a result of determining the frequency characteristics (a piano tune or a guitar tune) or the like of the acoustic signal. This enables the acoustic system to select an output device suitable for music or the like to be reproduced, based on the frequency characteristics of the acoustic signal and on the performance (full-range or otherwise) of a speaker device or the characteristics of a soundboard vibration device (the shape or the like of the soundboard).

In the acoustic system according to the technology disclosed in this patent application, the at least one output device may include a vibrator configured to vibrate in a manner determined by the acoustic signal, and a vibrated body configured to output the sound in response to the vibration of the vibrator, and the control unit may be further configured to control whether or not to supply the acoustic signal to the associated one of the at least one output device, based on the frequency characteristics of the acoustic signal and vibration characteristics of the vibrated body.

The sound quality of an output device that includes a vibrated body and a vibrator, such as a soundboard vibration device, depends on the frequency characteristics of an acoustic signal (drive signal or the like) supplied to the vibrator, because the shape and the like of the soundboard (vibrated body) vary from one type of output device to another. For instance, there is a chance of troubles such as the emission of an unintended sound from the output device, depending on the frequency characteristics of the acoustic signal supplied to the vibrator. It is therefore preferred to supply an acoustic signal to an output device that includes a soundboard vibration device or the like when the frequency characteristics of the acoustic signal to be supplied are suitable for the vibration characteristics of the vibrated body. In this acoustic system, the control unit may prevent the trouble described above by controlling whether or not to supply an acoustic signal to its associated output device based on the vibration characteristics of the vibrated body and the frequency characteristics of the acoustic signal.

In the acoustic system according to the technology disclosed in this patent application, the at least one output device may include a vibrator configured to vibrate in a manner determined by the acoustic signal, and a vibrated body configured to output the sound in response to the vibration of the vibrator, and the control unit may be further configured to control a change to the frequency characteristics of the acoustic signal that is output to the associated one of the at least one output device, based on the frequency characteristics of the acoustic signal and vibration characteristics of the vibrated body.

In the case where the frequency characteristics of an acoustic signal supplied to an output device that includes a vibrated body and a vibrator, such as a soundboard vibration device, are not suitable to the vibration characteristics of the vibrated body, a possible solution is, for example, to extract a signal that has suitable frequency characteristics and give only the extracted signal to the output device. In this acoustic system, the control unit controls a change to the frequency characteristics of an acoustic signal supplied to its associated output device, based on the vibration characteristics of the vibrated body and the frequency characteristics of the acoustic signal. In the case where the output device associated with the control unit is a piano that includes a soundboard vibration device, for example, the control unit changes the frequency characteristics of an acoustic signal (through the extraction (filtering) of a frequency component, enhancement, the reduction of an unnecessary frequency component, frequency conversion, or the like) to frequency characteristics suitable to the vibration characteristics of the soundboard of the piano. Troubles such as the emission of an unintended sound from the output device may be prevented in this manner.

The technology disclosed in this patent application can provide, for example, the acoustic system capable of switching from one of output devices that are connected to a network to another as a destination to which an acoustic signal is to be supplied.

While there have been described what are at present considered to be certain embodiments of the invention, it will be understood that various modifications may be made thereto, and it is intended that the appended claims coverall such modifications as fall within the true spirit and scope of the invention.

What is claimed is:

1. An acoustic system comprising:

a supply device connectable to a network and configured to supply an acoustic signal to the network; and a plurality of output devices each configured to output a sound based on the acoustic signal supplied from the supply device via the network, wherein each of the plurality of output devices includes a control unit configured to control outputting of the acoustic signal to at least one output device, from among the plurality of output devices, based on frequency characteristics of the acoustic signal.

2. The acoustic system according to claim 1, wherein the supply device is further configured to broadcast the same acoustic signal to all of the plurality of output devices.

3. The acoustic system according to claim 1, wherein the supply device comprises an external storage configured to store the acoustic signal.

4. The acoustic system according to claim 1, wherein the supply device comprises one of a TV, a radio, or a device playing video or audio.

5. The acoustic system according to claim 1, wherein the acoustic signal comprises music data created by sampling a tune that is in a form of analog signals.

6. The acoustic system according to claim 1, wherein the acoustic signal comprises control data in which a music playing event is set.

7. An acoustic system comprising:

a supply device connectable to a network and configured to supply an acoustic signal to the network;

an output device configured to output a sound based on the acoustic signal supplied from the supply device via the network; and a control unit configured to control outputting of the acoustic signal to the output device, based on frequency characteristics of the acoustic signal, wherein the output device comprises a vibrator configured to vibrate in a manner determined by the acoustic signal, and a vibrated body configured to output the sound in response to the vibration of the vibrator, and wherein the control unit is further configured to determine whether or not to supply the acoustic signal to the output device, based on the frequency characteristics of the acoustic signal and vibration characteristics of the vibrated body.

8. An acoustic system comprising:

a supply device connectable to a network and configured to supply an acoustic signal to the network;

an output device configured to output a sound based on the acoustic signal supplied from the supply device via the network; and a control unit configured to control outputting of the acoustic signal to the output device, based on frequency characteristics of the acoustic signal, wherein the output device comprises a vibrator configured to vibrate in a manner determined by the acoustic signal, and a vibrated body configured to output the sound in response to the vibration of the vibrator, and wherein the control unit is further configured to control change in the frequency characteristics of the acoustic signal output to the output device, based on the frequency characteristics of the acoustic signal and vibration characteristics of the vibrated body.

9. An acoustic system comprising:

a plurality of output devices connectable to each other via a network, each of the plurality of output devices being configured to output a sound based on the acoustic signal, wherein each of the output devices comprises:

an acoustic signal obtaining unit configured to obtain an acoustic signal via the network;

an optimum frequency characteristics obtaining unit configured to obtain, from each of the plurality of output devices, optimum frequency characteristics thereof; and a selection unit configured to select, from among the plurality of output devices, based on the acoustic signal and on the optimum frequency characteristics of each of the plurality of output devices, at least one output device to which the acoustic signal is to be output.

10. The acoustic system according to claim 9, wherein the acoustic signal is obtained from a supply device, which is connected to the output device via the network.

11. The acoustic system according to claim 9, wherein the selection unit is further configured to select the at least one output device based on a selection that is made in the past with respect to the acoustic signal.

12. The acoustic system according to claim 9, wherein:

the acoustic signal comprises music data, and the selection unit is further configured to switch the at least one selected output device while one piece of the music data is output.

13. The acoustic system according to claim 9, wherein the output device comprises one of a speaker device, a player piano, a TA piano, or a TA guitar system.

14. The acoustic system according to claim 10, wherein the supply device is further configured to broadcast the same acoustic signal to all of the plurality of output devices.

15. An acoustic system controlling method comprising the steps of:

supplying an acoustic signal to a network using a supply device connectable to the network;

outputting a sound based on the acoustic signal supplied from the supply device via the network using a plurality of output devices each having a control unit; and controlling outputting of the acoustic signal to at least one output device from among the plurality of output devices, based on frequency characteristics of the acoustic signal using the control unit from any of the plurality of output devices.

* * * * *